United States Patent [19]

Bevilacqua

[11] Patent Number: 4,930,272

[45] Date of Patent: Jun. 5, 1990

[54] DRAIN SYSTEM

[75] Inventor: Joseph Bevilacqua, Akron, Ohio

[73] Assignee: B-Dry Systems, Copley, Ohio

[21] Appl. No.: 267,437

[22] Filed: Nov. 4, 1988

[51] Int. Cl.[5] ..... E02D 19/00

[52] U.S. Cl. ..... 52/169.5; 405/43; 405/45; 405/36

[58] Field of Search ..... 52/169.5, 169.14; 405/43, 45, 36

[56] References Cited

U.S. PATENT DOCUMENTS

| | | | |
|---|---|---|---|
| 3,654,765 | 4/1972 | Healy | 52/169.5 |
| 3,850,193 | 11/1974 | Guzzo | 52/169.5 |
| 4,075,800 | 2/1978 | Molick | 52/169.5 |
| 4,360,042 | 11/1982 | Fouss | 405/45 |
| 4,572,700 | 2/1986 | Mantarro | 405/45 |
| 4,590,722 | 5/1986 | Bevilacqua | 52/169.5 |
| 4,749,306 | 1/1988 | Demeny | 405/45 |

FOREIGN PATENT DOCUMENTS

| | | | |
|---|---|---|---|
| 2017732 | 10/1971 | Fed. Rep. of Germany | 405/43 |

*Primary Examiner*—Henry E. Raduazo

*Attorney, Agent, or Firm*—Oldham & Oldham Co.

[57] ABSTRACT

A drainage system comprising an earthen trench adjacent to a foundation wall formed from hollow blocks or bricks, the inner surface of the lowermost course of which is provided with holes communicating with the interior of the blocks, allowing water passing down the interior of the wall to have access to the trench. The drainage trench is provided with a shaped profile, supported from the inner side of the wall, which serves as a lining for the top and one side of the trench, the lower portion of the wall, or a footer wall, comprising the other side. The bottom of the trench is lined with a water-permeable fibrous mat.

9 Claims, 1 Drawing Sheet

DRAIN SYSTEM

TECHNICAL FIELD

This invention relates to an improved drainage system especially useful for buildings. More particularly, this invention relates to simplified drain structures adapted to drain water away from foundation walls which utilizes a lined earthen drainage trench as part of the structure thereof. Specifically, this invention relates to earthen trench foundation drains defined in their top and on one side by a drain lining member, on the other side by a footer wall, and on the bottom by a non-woven fabric.

BACKGROUND OF THE INVENTION

In order to prevent water accumulating around the foundations of building structures from entering through the foundation walls, or otherwise, into the confines of the buildings, particularly into the lower parts thereof such as basements, it is customary to place drains adjacent to the foundations to carry accumulating water away before it rises to levels which would allow its entry into the buildings. Commonly, sections of abutting clay tiles are placed adjacent to the building footer for the purpose or more recently, use has been made of continuous flexible pipe fabricated from plastic-covered wire spiraling, perforated to admit accumulating water for disposal.

While the foregoing systems accomplish the drainage function, especially when initially installed, both have a tendency to admit dirt and silt with time, eventually becoming partially or totally plugged from such adventitiously entering material, impairing or destroying the draining efficiency.

Other drain systems have also been devised including that disclosed in my own prior U.S. Pat. No. 3,287,866, which comprehends drainage tiles positioned adjacent the inner face of an outer block wall footer. Openings are provided in the inner face of the block-wall so that water seeping into the wall can flow out to a gravel bed adjacent to the footer, and into drain tiles embedded therein. While the gravel bed retards the silting process, the drain tiles still eventually become plugged with silt or dirt, impeding the flow of the drain water therethrough. Furthermore, chemicals such as iron and lime, naturally present in the water, tend to accumulate on the gravel, while the gravel itself tends to settle and become tightly packed, both effects tending to slow down and prevent good drainage in the system.

Reference is also made to another of my prior patents, U.S. Pat. No. 4,612,742, relating to an improved wall and foundation drainage construction which utilizes a drainage member secured to an upper, inner surface of the footer and connecting to drainage openings provided in a bottom block of the wall, the drainage member extending out to gravel associated with drain tiles. While improved drainage action can be obtained from a construction of the type contemplated by the patent, to a degree, the system is still susceptible to the build-ups and plugging problems previously described.

Reference is also had to a still further of my prior patents, U.S. Pat. No. 4,590,722, which teaches a hollow drain member positioned in an earthen trench with a cover plate extending from a support on an adjacent foundation wall to the drain member. Although the invention described in the patent to a large extent avoids the plugging problems which afflict most drainage systems, the components of the system are relatively elaborate, and the installation of the system consequently not inexpensive.

DISCLOSURE OF THE INVENTION

In view of the preceding, therefore, it is a first aspect of this invention to provide a drainage system which exhibits little tendency to become blocked with silt or other adventitiously introduced material.

A second aspect of this invention is to provide a drainage system which is fabricated from less costly, simplified components.

Another aspect of this invention is to furnish a drainage system which is easily and rapidly, and therefore relatively inexpensively, installed.

An additional aspect of this invention is the provision of a drainage system for foundation walls which is more efficient, and consequently, more effective in draining accumulated water away from foundation walls.

A further aspect of this invention is to eliminate erosion of the earth in the drainage trench which forms part of the drainage system contemplated.

The foregoing and other aspects of the invention, as will become apparent in the following detailed description of the invention, are provided by a foundation wall drainage system comprising:

a footer wall;

an earthen drainage trench;

a wall formed of hollow building blocks provided with connecting openings through the top and bottom thereof, said blocks being disposed vertically on top of each other, with the lowermost row of said blocks having spaced holes penetrating the inner wall side thereof which function as drainage passageways, said spaced holes being located substantially adjacent to said drainage trench;

a drainage trench upper-lining member, and a drainage trench lower-lining member, wherein said upper-lining member is supported from said inner wall side, above said spaced holes, while said lower-lining member is disposed on the bottom of said trench.

The foregoing and still other aspects of the invention are provided by a foundation wall drainage system comprising:

an earthen drainage trench;

a wall formed of hollow building blocks provided with connecting openings through the top and bottom thereof, said blocks being disposed vertically on top of each other, with the lowermost row of said blocks having spaced holes penetrating the inner wall side thereof which function as drainage passageways, said spaced holes being located substantially adjacent to said drainage trench;

a drainage trench upper-lining member, supported from said inner wall side, above said spaced holes, which serves as a lining for the top and one side of said drainage trench;

a drainage trench lower-lining member which serves as a lining for the bottom of said trench, and a footer wall which forms a lining for the other side of said trench, wherein said lower-lining member comprises a non-woven fabric matting and said upper-lining member comprises a shaped profile.

BRIEF DESCRIPTION oF THE DRAWINGS

The invention will be better understood when reference is had to the following drawings, in which like numbers refer to like parts, and in which.

BEST MODE FOR CARRYING OUT THE INVENTION

Figure 1:
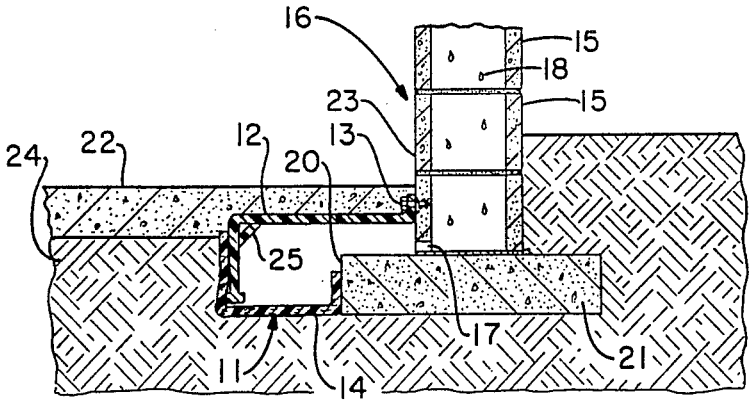
FIG. 1 represents a fragmentary section of a portion of a basement wall and floor embodying the principles and components of the present invention.

FIG. 1 represents a fragmentary section of a basement wall floor embodying the principles and components of the present invention. The Figure shows a foundation wall comprised of, for example, concrete blocks 15, better shown in FIG. 1A, having connecting openings 19 extending through the top of the blocks, to the bottom thereof, which allow moisture 18 penetrating into the interior of the blocks to drop to the bottom of the wall 16. Water thus accumulating, is drained from the wall through drain holes 17, passing over the top of the footer 21 and into a drainage ditch or trench, generally 11. The drainage trench is lined with a generally "Z-shaped" upper-lining member 12 which defines the top and one side of the trench. The upper-lining member 12 is supported from the inner wall surface 21 by means of fasteners 13 which extend through one end of the liner into the wall surface, while the other end of the liner rests on a lower-lining member 14, disposed at the bottom of trench 11 being a fibrous mat which desirably extends part-way up the sides of the trench as well. Footer wall 20 defines the side of the trench opposite the side defined by upper-lining member 12. A concrete floor 22 is poured over the upper-lining member 12, and on top of the adjacent earth 24 which surrounds the entire foundation assembly.

The drainage system shown has many advantages including the fact that it is rapidly and easily fabricated since it simply entails providing a drainage trench in the earth adjacent the footer wall 20, or adjacent to the lower part of the wall 16 itself, in instances where no footer is employed, laying the matting 14 in the trench, and attaching the covering upper-liner to the inner side 23 of the foundation wall over the drain holes 17, which latter are spaced along the lowermost part of the wall, at least one hole being provided in each concrete block. Furthermore, since there is no intervening structure between the drainage holes 17 and the drainage trench 11, water accumulating in and around the wall 16 has immediate access to the trench, resulting in a much more efficient and rapid drainage action. The drain liner mat 14 is readily penetrated by moisture entering the trench from the surrounding earth, yet it acts as a barrier to prevent penetration of the surrounding earth into the trench, which could result in blockage problems as well as erosion and ultimate undermining of the entire foundation.

The dimensions of the Z-shaped upper-lining member 12 may be varied within broad limits, and will depend on the sizes of the footer wall and the adjacent trench, the latter depending in part on the volume of drainage water anticipated; however, typically, the horizontal portion of the lining member will be from about 7 to 9 inches wide, while the vertical wall portion resting on the bottom of the trench will be from about 4 to 6 inches high. Conveniently, the vertical lip, i.e., the part of the member attached to the inner wall surface 23, will be from about 1 to 3 inches high, and while other thicknesses, particularly greater thicknesses, may be used, the upper-lining member will usually be about $\frac{1}{8}$ inch thick.

It is sometimes desirable to provide the upper lining member with reinforcing structure to improve its strength and rigidity so as to enable it to better withstand the forces to which it is subjected, for example, the weight of the floor 22 above it. In such cases it has been found to be of advantage to provide the member with a supporting structure or fillet, for example that shown at 25. Such structure may take the form of small triangular members positioned at intervals along the longitudinal axis of the upper-lining member 12 between the portions of the upper lining member defining the top and one side of the trench, or it may be formed as a continuous structure. A continuous structure is sometimes desirable in that it facilitates construction of the reinforced upper-lining member by extrusion.

Although any of various materials including metal, such as galvanized steel and the like may be used, due to the corrosive service to which the assembly is subjected, it is preferred that the lining member 12 be formed from plastic such as, for example, polyvinylchloride (PVC), polyethylene, polypropylene or others. The use of plastic also permits low cost manufacture of the lining member since it can, for example, be extruded as a shaped profile, as well as molded or otherwise fabricated. The fastener 13 may be a concrete nail, or similar fastener; however, the use of plastic fasteners, such as for instance, a plastic rivet is preferred, again because of the corrosive environment in which the system operates.

The drain lining matting 14 in the assembly described will commonly be fabricated from flexible matting about 14 inches to 20 inches wide, and approximately $\frac{1}{8}$ inch to $\frac{1}{4}$ inch thick. The matting material may be either woven or non-woven, and should be resistant to rot, particularly under moist conditions. In view of the harsh environment in which the mat is installed, it has been found that synthetic materials, such as polyesters, nylon, polyolefins, and the like are especially suitable. In a preferred embodiment of the invention, a non-woven polyester matting will be employed. Matting of the type described will typically have a weight of from about 15 to 20 ounces per square yard.

Figure 2:
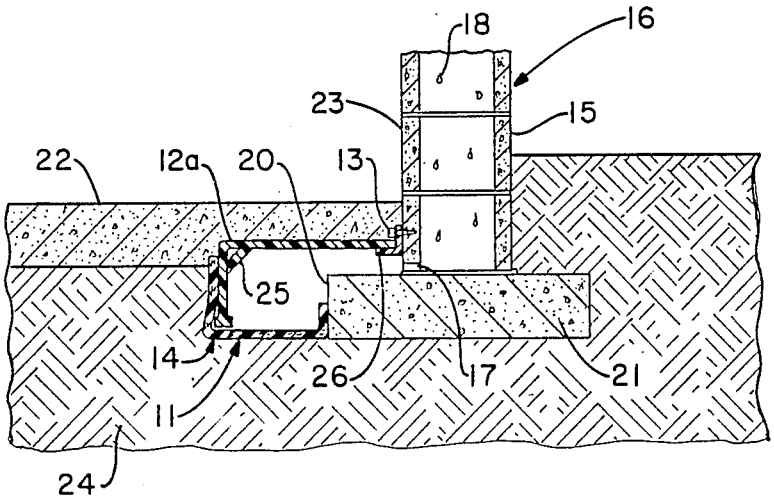
FIG. 2 represents another fragmentary section of a portion of a basement wall and floor illustrating a different embodiment of the invention.

FIG. 2 represents another fragmentary section of a portion of a basement wall and floor illustrating a different embodiment of the invention. While the generally Z-shaped upper-lining 12, shown in connection with FIG. 1, permits a single-step installation procedure, involving fastening the lining to the wall, it is frequently of advantage to modify the drainage assembly in a manner which permits compensating adjustments to be made to the assembly to allow for variations in the position of the of the foundation structure relative to the drainage trench. Such an adjustable system is described in connection with FIG. 2. As shown in the Figure, a generally "L-shaped" upper-lining member **12*a* is disposed over the trench, one flange of which rests on a shelf member 26 fastened to the inner wall surface 23 by a fastener 13, while the other flange of the member rests on the drain liner mat 14, disposed at the bottom of the trench 11. The advantage of the configuration is that the horizontal upper flange of the lining member 12***a* can be moved towards or away from the foundation wall, resting on the shelf member 26, to compensate for variations in the location of the footer wall 20, relative to the location of the ditch 11. Again, moisture 18 within the wall is provided with access to the drainage assembly through the drain holes 17. Once the drain mat 14 has been installed, and the upper-lining member 12*a* has been properly adjusted over shelf 26, the concrete floor 22 is poured, completing the assembly and providing rapid and efficient drainage in and around the wall 16 and the surrounding earth.

The dimensions of the L-shaped shelf member 26 may be varied within considerable limits, the horizontal flange of the shelf frequently being made longer than the vertical flange which provides attachment to the inner wall surface 23. For example, while a shelf with flanges from about 2 to 3 inches wide is commonly used, the horizontal flange will frequently be from about 2 to 4 inches wide, to permit greater adjustability of the upper-lining 12*a*.

Figure 1A:
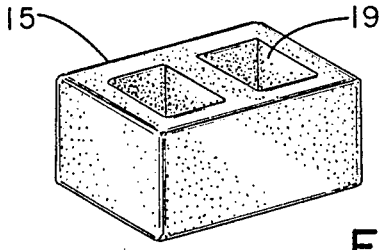
FIG. 1A shows an isometric view of a concrete block commonly used to fabricate foundation walls of the type contemplated by the invention.

Although the drainage assembly of the invention is particularly useful with concrete blocks as shown in FIG. 1A, it may also be successfully used with other building materials, such as hollow bricks and the like. Also, while FIGS. 1 and 2 show transverse cross-sections of the upper-lining member 12 and drain lining matting member 14, it is to be understood that such members extend along the foundation wall in association with the drainage trench 11, to a point of connection with disposal means of the type well known to the art, where ultimate disposition of the drainage water is made.

While in accordance with the patent statutes only the best mode and preferred embodiment of the invention has been illustrated and described in detail, it is to be understood that the invention is not limited thereto or thereby, but that the scope of the invention is defined by the appended claims.

What is claimed is:

1. A foundation wall drainage system comprising:

a footer wall;

an earthen drainage trench having a top, a bottom, a first side, and a second side wherein said trench functions as a conduit for drainage water passing through said system; and a wall formed of hollow building blocks provided with connecting openings through a top and a bottom thereof, said blocks being disposed vertically on top of each other, with a lowermost row of said blocks having spaced holes penetrating an inner wall side thereof which function as drainage passageways, said spaced holes being located substantially adjacent said drainage trench wherein the improvement comprises;

a drainage trench lower-lining member, wherein said lower-lining member is disposed on said bottom of said trench extending across the entire bottom of said trench and extending partially up said footer wall and up said second side of said trench; and a drainage trench upper-lining member wherein said upper-lining member is supported from said inner wall side, above said spaced holes, at one end, while a second end rests on said lower-lining member, said trench being faced on said first side thereof by said footer wall, on said second side and said top thereof by said upper lining member and on said bottom thereof by said lower lining member.

2. A drainage system according to claim 1 wherein said upper-lining member is provided with reinforcing structure positioned between said top and said one side of said lining.

3. A foundation wall drainage system according to claim 1, wherein said upper-lining member is a member having a generally Z-shaped transverse cross-section, said member being supported from said inner wall side by attachment thereto, and said lower-lining member is comprised of a fibrous matting.

4. A system according to claim 3 wherein said fibrous matting is a non-woven polyester fabric.

5. A system according to claim 1 wherein said upper-lining member is a member having generally L-shaped transverse cross-section, one flange of said L resting on a shelf member attached to said inner wall side, and said lower lining-member is comprised of fibrous matting.

6. A foundation wall drainage system according to claim 5, wherein said shelf comprises a generally L-shaped member, one flange of which is attached to said inner wall by means of fasteners.

7. A system according to claim 5, wherein said fibrous matting is a non-woven polyester matting.

8. A foundation wall drainage system comprising:

a footer wall;

an earthen drainage trench wherein said footer wall is one side of said trench and a second side of said trench is earthen; and a wall formed of hollow building blocks provided with connecting openings through a top and a bottom thereof, said blocks being disposed vertically on top of each other, with a lowermost row of said blocks having spaced holes penetrating an inner wall side thereof which function as drainage passageways, said spaced holes being located substantially adjacent to said drainage trench wherein the improvement comprises;

a drainage trench lower-lining member which serves as a lining for the bottom of said trench wherein said lower-lining member comprises a non-woven fabric matting extending across the entire bottom portion of said trench and extending partially up said footer wall and extending partially up said second side of said trench, and a drainage trench upper-lining member, supported from said inner wall side, above said spaced holes, at one end, which serves as a lining for said top of said trench, and a second end which rests on said lower-lining member, and wherein said lower-lining member and said upper-lining member comprise the earthen side of said drainage trench and wherein said upper-lining member comprises a shaped profile, and wherein said lower-lining member comprises non-woven fabric matting.

9. A system according to claim 8 in which said non-woven fabric matting and said shaped profile are fabricated from plastic.

* * * * *